US008172672B2

(12) United States Patent
Koyama

(10) Patent No.: US 8,172,672 B2
(45) Date of Patent: May 8, 2012

(54) GAME JUDGMENT SYSTEM

(75) Inventor: Toshimi Koyama, Koto-ku (JP)

(73) Assignee: Universal Entertainment Corproation, Koto-Ku, Tokyo (JP)

( * ) Notice: Subject to any disclaimer, the term of this patent is extended or adjusted under 35 U.S.C. 154(b) by 406 days.

(21) Appl. No.: 12/402,109

(22) Filed: Mar. 11, 2009

(65) Prior Publication Data

US 2009/0233699 A1 Sep. 17, 2009

(30) Foreign Application Priority Data

Mar. 14, 2008 (JP) ..... 2008-065701

(51) Int. Cl.
*A63F 9/24* (2006.01)

(52) U.S. Cl. ..... 463/25

(58) Field of Classification Search ..... 463/16–25, 463/39–42

See application file for complete search history.

(56) References Cited

U.S. PATENT DOCUMENTS 5,735,742 A * 4/1998 French ..... 463/25
2006/0160600 A1* 7/2006 Hill et al. ..... 463/17

FOREIGN PATENT DOCUMENTS

JP 2004-102953 4/2004
JP 2004-105321 4/2004

* cited by examiner

*Primary Examiner* — Ha Tran T Nguyen
*Assistant Examiner* — Vongsavanh Sengdara
(74) *Attorney, Agent, or Firm* — Lexyoume IP Group, PLLC

(57) ABSTRACT

A server device uses cameras to capture the images of cards dealt to players and a dealer. The server device automatically judges the game win/lose result of the players and the dealer and the dividends of the players through image recognition based on the card images from the cameras. The server device reads information from the wireless IC tags provided on game chips to judge the dividends of the players. The server device compares between the two dividends of a player to judge whether or not the dividends are inconsistent. If the dividends are inconsistent, the server device notifies the dealer and a casino hotel manager that the dividends are inconsistent.

11 Claims, 11 Drawing Sheets

FIG. 12

TIME INFORMATION : (2008. 04. 01) 17 : 26 : 10

| | IDENTIFICATION INFORMATION | HAND | WIN/ LOSE | STAKE | ODDS | DIVIDEND | ACTUAL DIVIDEND |
|---|---|---|---|---|---|---|---|
| D | | DIAMOND 5<br>SPADE A<br>⋮ | LOSE | | | | |
| P1 | 001 | HEART A<br>DIAMOND 3<br>⋮ | WIN | 2 $ | 2 | 4 $ | 4 $ |
| P2 | 002 | CLUB K<br>SPADE 2<br>⋮ | LOSE | 5 $ | 0 | 0 $ | 0 $ |
| P3 | 003 | DIAMOND 4<br>HEART Q<br>⋮ | WIN | 10 $ | 2 | 20 $ | 20 $ |

GAME JUDGMENT SYSTEM

CROSS REFERENCE TO RELATED APPLICATION

This application claims benefit of priority under 35 U.S.C. §119 to Japanese Patent Application No. 2008-065701, filed on Mar. 14, 2008, the entire contents of which are incorporated by reference herein.

BACKGROUND OF THE INVENTION

1. Field of the Invention

The present invention relates to a game judgment system that is applied to a game (for example, card game, roulette) in which a game medium such as a game chip is bet.

2. Description of the Related Art

Patent Document 1 (Japanese Patent Application No. 2004-105321) and Patent Document 2 (Japanese Patent Application No. 2004-102953) disclose a technology in which, when radio waves are generated by an X-side sending antenna and a Y-side sending antenna, a radio wave is generated by a flux, which is at the XY crossing point and is vertical to the table, for reading the ID of the wireless IC tag included in the game chip at the crossing point on the table. This reading is performed sequentially for each bet unit.

If a wireless IC tag is included in a legitimate game chip as in the technology disclosed in Patent Documents 1 and 2 so that the ID of this wireless IC tag can be read, the use of an illegitimate and fake game chip can be prevented.

However, though the use of a fake game chip can be prevented by reading a wireless IC tag included in a game chip, it is impossible to check that a game dealer, who is in conspiracy with a game player, pays a fraudulent dividend game chip to the player. It is also impossible to check an error that a dealer mistakenly returns more game chips to a player than the player is to receive as dividends.

Conventionally, there is no means for preventing more game chips than a player is to receive as dividends from being returned intentionally or mistakenly. This problem has been a burden on the persons concerned with game halls.

SUMMARY OF THE INVENTION

In view of the foregoing, it is an object of the present invention to provide the ability to prevent more chips than a player is to receive as dividends from being returned to the player intentionally or mistakenly and thereby to reduce the burden on the persons concerned with game halls.

To achieve the object described above, the present invention provides a game judgment system comprising: a game betting board; a reading unit that regularly reads chip information which is information on game chips placed in a predetermined range on the game betting board; an information accumulation unit that accumulates chip information, which is regularly read by the reading unit, and time information; a difference judgment unit that judges a difference between a value of the game chips identified by first chip information accumulated by the information accumulation unit and a value of the game chips identified by second chip information accumulated in conjunction with the time information earlier than the time information on the first chip information; a game result judgment unit that judges a result of a game on which the game chips are bet on the game betting board; and an inconsistency judgment unit that judges whether or not there is an inconsistency between the game result judged by the game result judgment unit and the difference judged by the difference judgment unit.

The system of the present invention automatically judges the game result and the dividend returned to a player to check whether or not a dividend higher than the dividend based on the game result is returned. So, the system reduces the load on those, such as game hall managers, who want to prevent an error caused intentionally or mistakenly.

In a preferred embodiment of the present invention, the game judgment system further comprising a notifying unit that, if the inconsistency judgment unit judges that there is an inconsistency, sends information indicating there is an inconsistency.

In this embodiment, if there is an inconsistency between the game result and the dividend returned to a player, the system notifies the game dealer and the game hall owner that there is an inconsistency, thus preventing game chips from being returned incorrectly.

In a preferred embodiment, the information accumulation unit compares chip information read by the reading unit with chip information accumulated previously and, if both differ, accumulates the chip information read by the reading unit and, if both are the same, discards the chip information read by the reading unit.

In this embodiment, the system eliminates the need for accumulating unnecessary chip information and time information, thus reducing the required capacity of a storage device used as the information accumulation unit.

BRIEF DESCRIPTION OF THE DRAWINGS

FIG. 12 is a diagram showing the concept of information stored during the game judgment processing according to the embodiment of the present invention.

DESCRIPTION OF THE EMBODIMENTS

An embodiment of the present invention will be described below with reference to FIG. 1 to FIG. 12.

Figure 1:
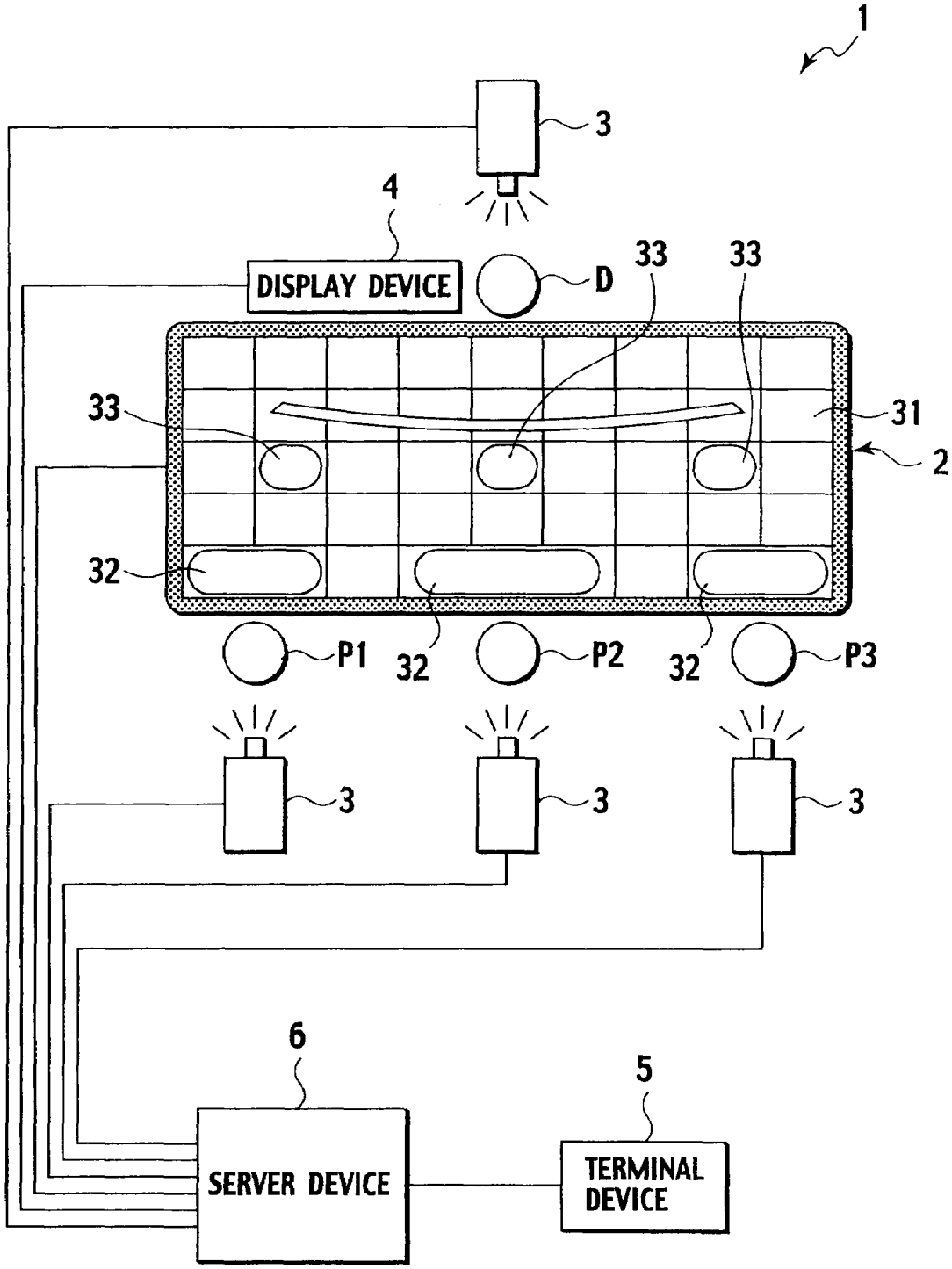
FIG. 1 is a block diagram showing the general configuration of a game management system according to an embodiment of the present invention.

FIG. 1 is a block diagram showing the general configuration of a game management system 1 according to an embodiment of the present invention.

The game management system 1 comprises a server device 6 that manages a game. The server device 6 is connected to a game betting device 2, multiple cameras 3, a display device 4, and a terminal device 5 via a predetermined communication interface (not shown). The game management system 1 is installed, for example, in a casino hotel. The game betting device 2, multiple cameras 3, and display device 4 are installed in the game hall of a casino hotel. The server device 6 is installed in the management room of a casino hotel. The terminal device 5 is installed in the room of a casino hotel manager.

The game betting device 2 is a device on which game chips 71 (see FIG. 2) for playing the blackjack are bet. This game betting device 2 has a game betting board 31. The game betting board 31 is a table on the surface of which the game chips 71 are bet. Around the game betting board 31 are provided the seat for the dealer D who deals the game and the seats for players P1, P2, and P3 who participate in the game.

The players P1, P2, and P3 play the game with the their game chips 71 stacked in their chip holding positions 32, located in front of the players, on the game betting board 31 and in the neighboring ranges. Each player starts a bet by taking out some of the stacked game chips 71 from the stacked game chips 71 for betting and moving those game chips from the chip holding position 32 to a betting position 33 in front of the chip holding position 32. When the result of the game is decided, the dealer D collects the game chips 71 from the betting positions 33 and places the game chips 71, which are to be returned to the winning player, in the position on the game betting board 31 in front of that player. The player accepts the returned game chips 71 and stacks them in his or her chip holding position 32.

The game betting device 2 reads information recorded in a wireless IC tag 72 of each game chip 71 placed on the game betting board 31 and sends the information to the server device 6. This information is read and sent regularly, for example, at a 5-second or 10-second interval under control of the server device 6.

The camera 3 is installed in each of the seats of the dealer D and the players P1, P2, and P3. This embodiment is described with the blackjack, one of card games, as an example. The cameras 3 take the photos of the cards of the dealer D and players P1, P2, and P3 and send the image data to the server device 6.

A message received from the server device 6 is displayed on the display device 4 and the terminal device 5 (on its display).

Figure 2:
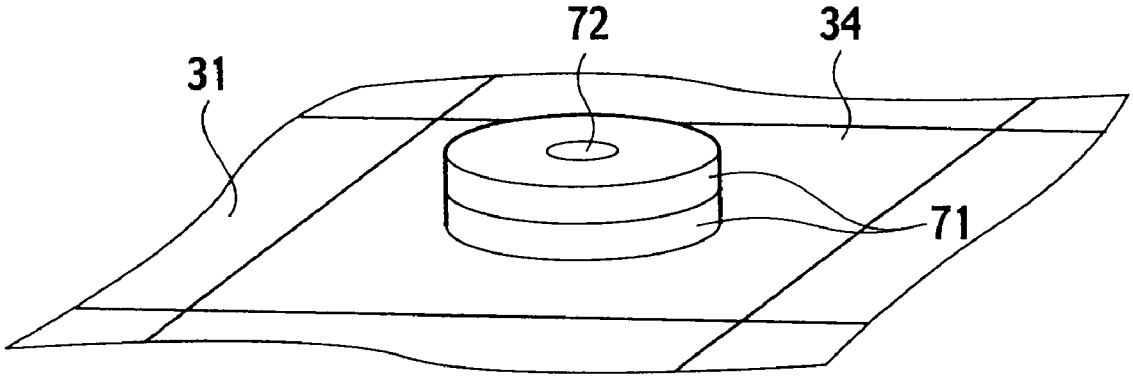
FIG. 2 is a diagram showing a game chip according to the embodiment of the present invention.

FIG. 2 is a diagram showing a game chip used in the game. Each game chip 71 has the wireless IC tag 72 embedded. The information on the game chip 71, which is recorded in the wireless IC tag 72, includes a unique number specifying the game chip 71 (a number identifying the game chip 71), the value of the game chip 71 (one-dollar, five-dollar, ten-dollar, etc.), the color of the game chip 71, and the place where the game chip 71 can be used (information identifying a casino hotel where the game chip 71 is used). It is also possible that only a unique number is recorded in the game chip 71 and the correspondence between the unique number and the other information is stored in the server device 6 so that the other information can be searched for based on the unique number read from the wireless IC tag 72.

Next, the following describes the detailed configuration of the game betting device 2.

Figure 3:
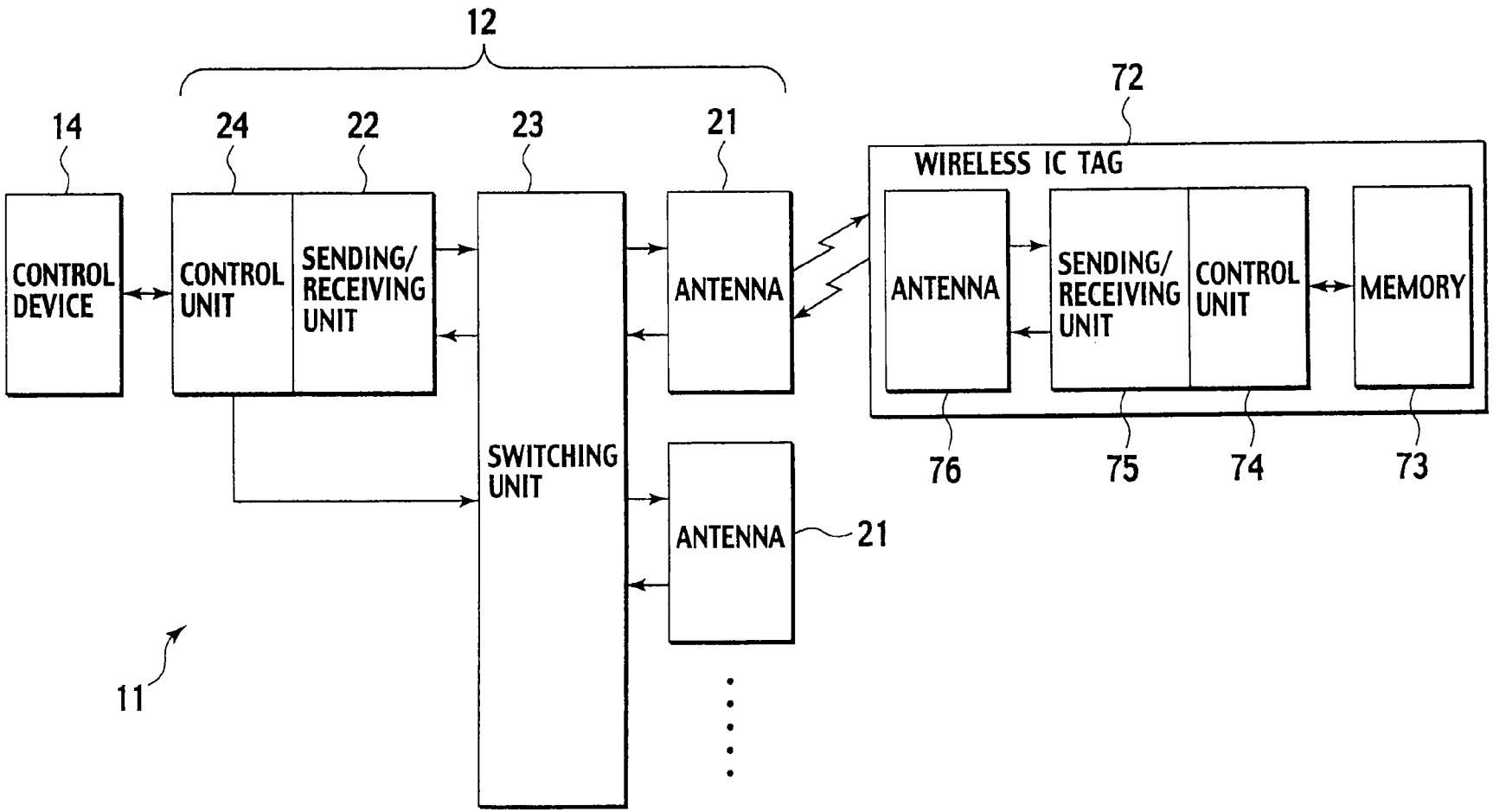
FIG. 3 is a block diagram showing a bet information detection device according to the embodiment of the present invention.

FIG. 3 is a block diagram showing a bet information detection device 11. The bet information detection device 11 is a device for reading the game chips 71 on the game betting device 2.

A control device 14 instructs a reading device 12 to generate a magnetic field for electro-motivating the wireless IC tag 72. The control device 14 also instructs the reading device 12 to read information from the wireless IC tag 72 and to send the information to the control device 14.

The reading device 12 comprises multiple antennas (loop antennas) 21, a sending/receiving unit 22, a switching unit 23, and a control unit 24.

The control unit 24 receives an instruction from the control device 14 and, based on the received instruction, drives the sending/receiving unit 22 and the switching unit The sending/receiving unit 22 turns on the antennas 21 to generate a magnetic field for electro-motivating the wireless IC tag 72. That is, the sending/receiving unit 22 sequentially switches the antennas 21 from one antenna to another to sequentially generate magnetic fields from the antennas 21. In addition, at the same time the magnetic field is generated, the sending/receiving unit 22 demodulates the load-modulated electric wave signal to read information from the wireless IC tag 72. The antennas 21 are provided, one for each area 34 on the game betting board 31.

The wireless IC tag 72, a magnetic field type wireless IC tag, comprises a memory 73, a control unit 74, a sending/receiving unit 75, and an antenna 76. The memory 73 is a storage device in which a unique number specifying the game chip 71 (a number identifying the game chip 71) is stored. As described above, the memory 73 may also include the value of the game chip 71 (one-dollar, five-dollar, ten-dollar, etc.), the color of the game chip 71, and the place where the game chip 71 can be used (information identifying a casino where the game chip 71 is used). The control unit 74 interprets a command, a request, and an instruction, received from the reading device 12, and executes the operation in response to them. The sending/receiving unit 75, which has a modulation unit (not shown) and a demodulation unit (not shown), modulates and demodulates signals to communicate with the reading device 12. The antenna 76, activated by the magnetic field received from the reading device 12, supplies power to the sending/receiving unit 75 and, at the same time, receives a modulated wave from the sending/receiving unit 75 and emits the modulated wave into space to allow the reading device 12 to receive it.

As described above, the bet information detection device 11 electro-motivates the wireless IC tag 72, and reads information from the wireless IC tag 72, via the antenna 21 of the reading device 12. It is also possible to perform those operations using different antennas.

Figure 4:
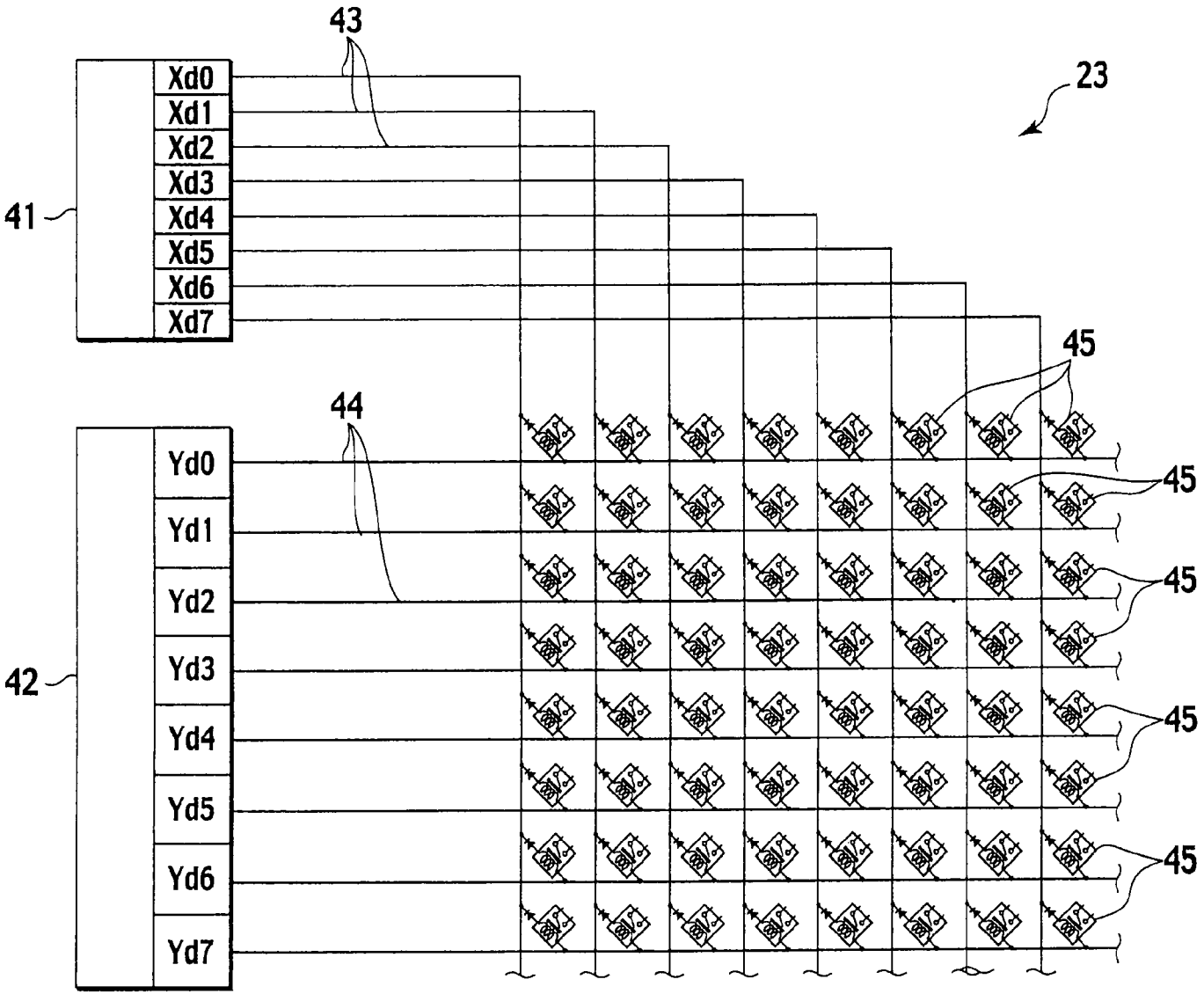
FIG. 4 is a circuit diagram showing a switching unit according to the embodiment of the present invention.
Figure 5:
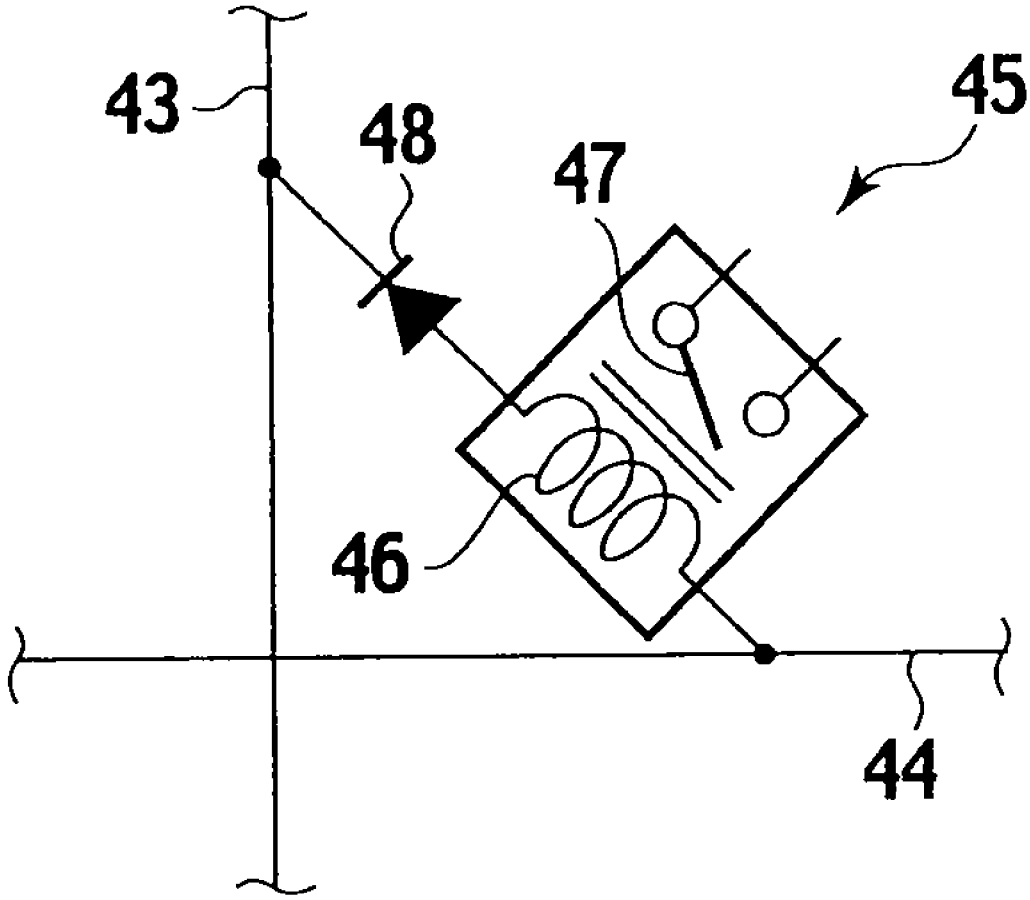
FIG. 5 is a circuit diagram showing the switching unit according to the embodiment of the present invention.
Figure 6:
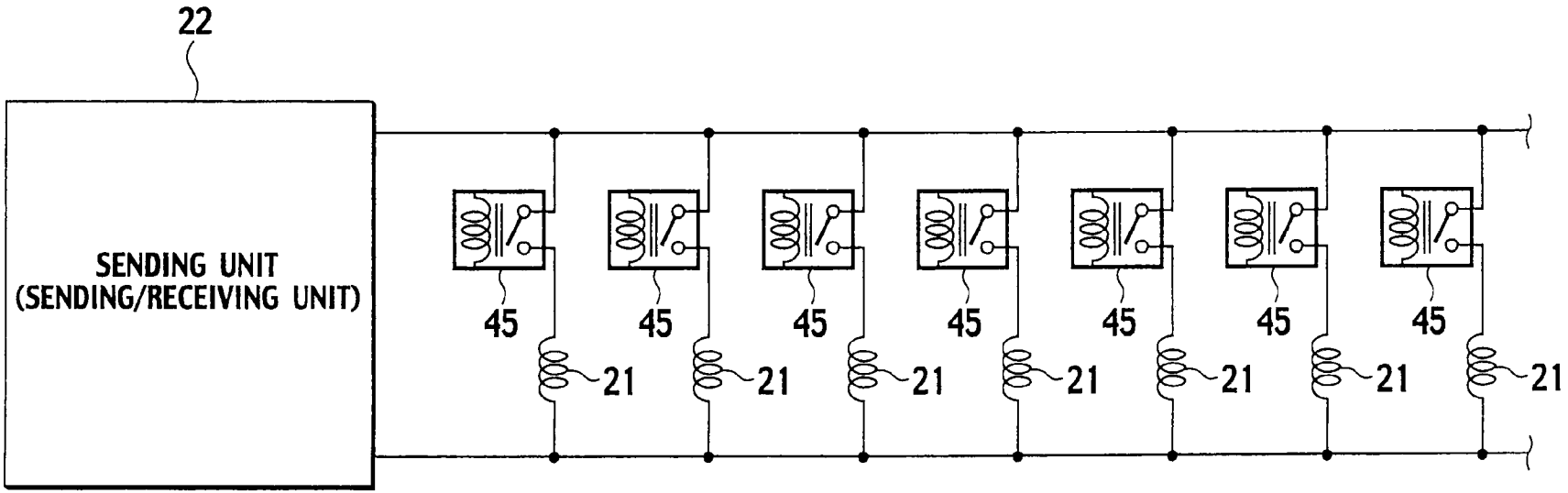
FIG. 6 is a circuit diagram showing the switching unit according to the embodiment of the present invention.

The following describes the switching unit 23 of the reading device 12. FIGS. 4 to 6 are circuit diagrams showing the configuration of the switching unit 23. The switching unit 23 comprises an X-side scan driver 41 and a Y-side scan driver 42. Multiple X-side sending lines 43, parallel to each other, extend from the X-side scan driver 41. Similarly, multiple Y-side sending lines 44, parallel to each other, extend from the Y-side scan driver 42. The multiple X-side sending lines 43 and the multiple Y-side sending lines 44 are arranged, one vertically and the other horizontally, with many crossing points between the vertical lines and horizontal lines. At each crossing point, a relay circuit 45 is provided. Each relay circuit 45 has one end of its coil 46 connected to the X-side sending line 43, and the other end connected to the Y-side sending line 44. On the side of the X-side sending line 43 with respect to the coil 46, a diode 48 is installed with its cathode on the side of the X-side sending line 43 and with its anode on the side of the coil 46. Normally, to turn off the relay circuit 45, the X-side sending line 43 connected to the relay circuit 45 is maintained high, and the Y-side sending line 44 connected to the relay circuit 45 is maintained low. And, to turn on a switch 47 of the relay circuit 45, the X-side sending line 43 connected to the relay circuit 45 is switched low, and the Y-side sending line 44 connected to the relay circuit 45 is switched high. This switching operation causes the coil 46 to be turned on and closes the switch 47.

As shown in FIG. 5, each antenna 21 has one relay circuit 45. More specifically, as shown in FIG.6, one antenna 21 is connected in series with one relay circuit 45. If the relay circuit 45 is off, the antenna 21 connected in series with that relay circuit 45 is not driven; if the relay circuit 45 is on, the antenna 21 connected in series with that relay circuit 45 is driven. This relay circuit 45 is a high-frequency relay.

Figure 7:
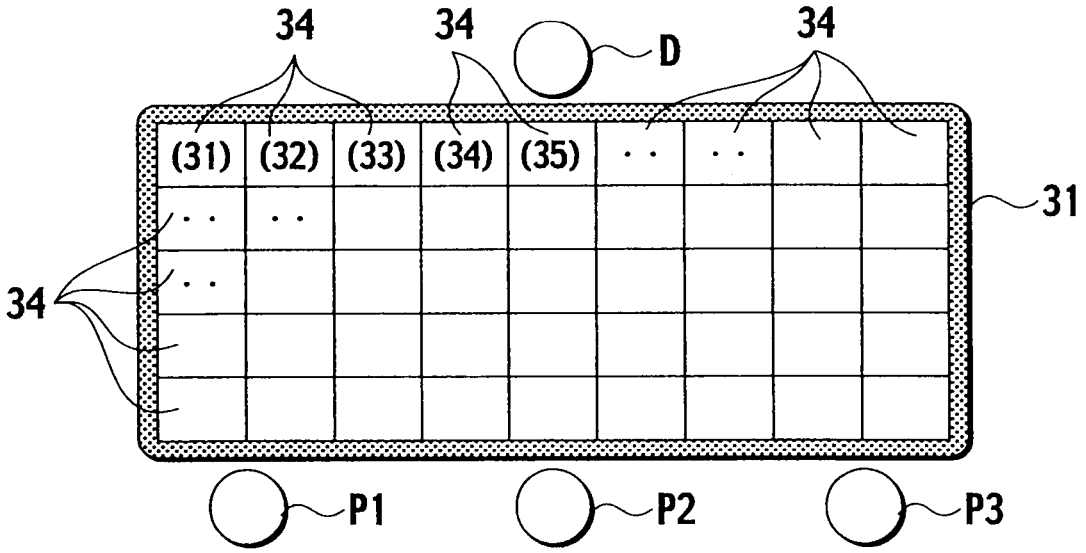
FIG. 7 is a diagram showing the areas provided on a game betting board according to the embodiment of the present invention.

FIG. 7 is a diagram showing the areas 34 provided on the game betting board 31. The game betting board 31 is divided into the areas 34. As shown in FIG. 7, the areas 34 are numbered as (31), (32), (33), and so on. The antennas 21 are provided, one for each area 34 on the game betting board 31, to read information from the wireless IC tags 72 of the game chips 71 placed in the areas 34. The reading device 12 drives the antennas 21 in order of (31), (32), (33), and so on to sequentially read information from the wireless IC tags 72 of the game chips 71 placed in the areas 34 each corresponding to the driven antenna 21. This operation allows the reading device 12 to check all areas 34 on the game betting board 31 and read information from the wireless IC tags 72 of the game chips 71. Even if multiple game chips 71 are stacked in one area 34, the information can be read from the wireless IC tags 72 of all stacked game chips 71.

Next, the following describes the configuration of the server device 6.

Figure 8:
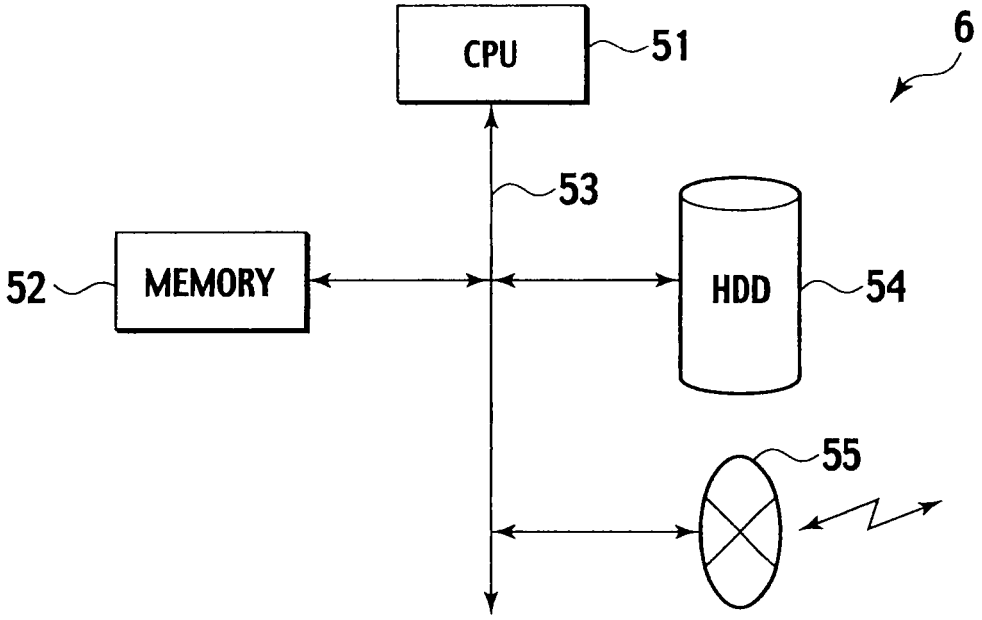
FIG. 8 is a block diagram showing a server device according to the embodiment of the present invention.

FIG. 8 is a block diagram showing the server device 6. The server device 6, which performs various types of operation, comprises a CPU 51 that integrally controls the units and a memory 52 composed of various types of RAM and ROM. The CPU 51 and the memory 52 are connected via a bus 53. Also connected to the bus 53 are a magnetic storage device 54, in which various programs and fixed data are stored via a predetermined interface, and a communication interface (I/F) 55 which communicates with the game betting device 2 (control device 14), cameras 3, display device 4, and terminal device 5.

Next, the following describes the control operation the server device 6 performs.

Figure 9:
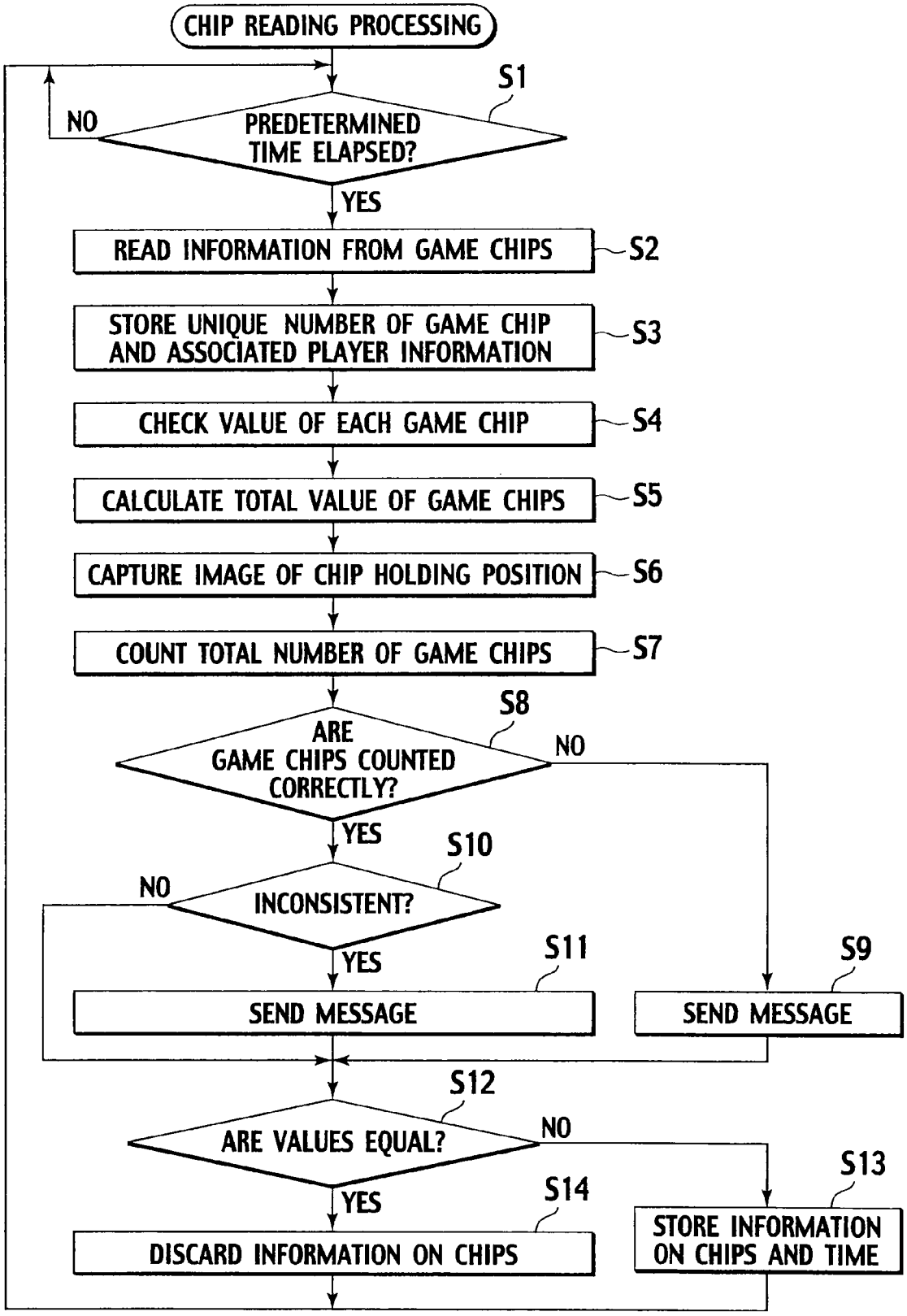
FIG. 9 is a flowchart showing chip reading processing according to the embodiment of the present invention.

FIG. 9 is a flowchart of the chip reading processing performed by the server device 6 (more specifically, the CPU 51). In step S1, the server device 6 checks if a predetermined time interval (for example, five seconds or ten seconds) has elapsed. If the predetermined time interval has elapsed, control is passed to step S2. If the predetermined time interval has not yet elapsed, step S1 is repeated. In step S2, the server device 6 reads information from the wireless IC tags 72 of the game chips 71 placed in the chip holding positions 32 provided on the game betting board 31 for the players P1, P2, and P3. Using the antennas 21 of the areas 34 corresponding to the chip holding positions 32 (including its neighboring range), the server device 6 reads the game chips 71 to identify the unique numbers of the game chips 71 currently placed in the chip holding positions 32 of the players P1, P2, and P3. The result of this operation shows the numbers of the game chips 71 currently placed in the chip holding positions 32 of the players P1, P2, and P3.

In this way, the server device 6 regularly reads a change in the value of the game chips 71 in each of the chip holding positions 32 of the players P1, P2, and P3 to know how much value of the game chips 71 the players P1, P2, and P3 bet in each game and how much value of the game chips 71 the players are refunded. That is, the server device 6 compares the result of the processing with that of the previous processing. And, the server device 6 judges that a player has bet game chips 71 if the value of the game chips 71 in the chip holding position 32 is decreased and judges that a player has received game chips 71 from the dealer D as the refund if the value of the game chips 71 in the chip holding position 32 is increased.

The unique number of each game chip 71, which is given to a player in the game hall at the beginning of a game, is associated with the identification information identifying the player, other information on the player, and information identifying a seat of the game betting board 31 where the player plays, and the unique number and its associated information are registered in the table in the server device 6. When the player wins a game, the unique number of a new game chip 71 returned from the dealer D is detected. In step S3, the server device 6 associates the unique number of a game chip 71, not found in the previous processing, with the identification information identifying the player and other information on the player and registers the unique number as well as the associated information in the table.

The values (one-dollar, five-dollar, ten-dollar, etc.) of the game chips 71 corresponding to the unique numbers of the game chips 71 are registered in a predetermined table stored in the server device 6. So, in step S4, the server device 6 references the predetermined table to check the value of each game chip 71. In step S5, the server device 6 calculates the total value of the game chips 71 each player has. It is also possible to store the value of a game chip 71 in the wireless IC tag 72 of the game chip 71.

By reading the wireless IC tags 72 of the game chips 71 as described above, the server device 6 gets information on the number of game chips 71 of each player (for example, five one-dollar, two five-dollar, one ten-dollar) and on the total value of the game chips 71 of each player.

In step S6, the camera 3 installed in each player's seat takes the photo of the game betting board 31 in front of each player. In this way, the images of the chip holding positions 32 of the players P1, P2, and P3 are sent regularly to the server device 6. In step S7, the server device 6 checks the image to count the total number of game chips 71 sacked in the chip holding position 32 of each player. In step S8, the server device 6 checks if the total number of game chips 71, stacked in the chip holding position 32 of each player, can be counted correctly through image recognition. If the total number of game chips cannot be counted correctly (for example, if the game chips 71 are not stacked properly or if the game chips 71 are not stacked in the correct position), control is passed to step S9. If the total number of game chips is counted correctly, control is passed to step S10. In step S9, the server device 6 sends a message to the display device 4 and the terminal device 5 to indicate that the image cannot be recognized correctly and notifies the dealer D and the casino hotel manager of the fact.

In step S10, the server device 6 compares the total number of each player's game chips 71, which were processed in steps S2 to S5, with the total number of each player's game chips 71 counted in step S7 to judge if they are consistent. If they are inconsistent, control is passed to step S11; if they are consistent, control is passed to step S12. When control is passed to step S11, there is a possibility that the player uses some fake game chips which are different from the legitimate game chips 71 used in the casino hotel. In this case, the server device 6 sends a message, which indicates that there is a possibility that the player uses fake game chips, to the display device 4 and the terminal device 5 to notify the dealer D and the casino hotel manager of the fact.

In step S12, the server device 6 compares the information on the value of the game chips 71 read in steps S2 to S5 with the information on the value of the game chips 71 read in the previous processing and accumulated in the magnetic storage device 54. If both values are equal, control is passed to step S14; if both values are not equal, control is passed to step S13. In step S13, the server device 6 stores the information on the game chips 71 that was read in the current processing, as well as the time information indicating the time at which the information was read, in the magnetic storage device 54. In step S14, the server device 6 discards the information on the game chips 71 that was read in the current processing instead of storing the information in the magnetic storage device 54.

By repeating steps S1 to S14 as described above, the server device 6 checks a change in the value of the game chips 71 each player accumulates in the chip holding position 32 as well as the time information to know how much value of the game chips 71 each player bet in one game and how much value of the game chips 71 each player gets as a return. That is, if the comparison of the value obtained by the current processing with the value obtained by the previous processing shows a decrease in the value of the game chips 71 accumulated in the chip holding position 32, the server device 6 judges that the player who sits in front of that chip holding position 32 has bet the game chips 71. Conversely, if the comparison of the value obtained by the current processing with the value obtained by the previous processing shows an increase in the value of the game chips 71 accumulated in the chip holding position 32, the server device 6 judges that the player who sits in front of that chip holding position 32 has received a return of the game chips 71 from the dealer D. So, if the comparison of the value obtained by the current processing with the value obtained by the previous processing shows an increase or decrease in the value of the game chips 71 accumulated in the chip holding position 32, the server device 6 stores the information on the game chips 71 that was read during the current processing. The time information stored in conjunction with the information on the game chips 71 indicates the time when the player bet game chips or when the player got a return.

Figure 10:
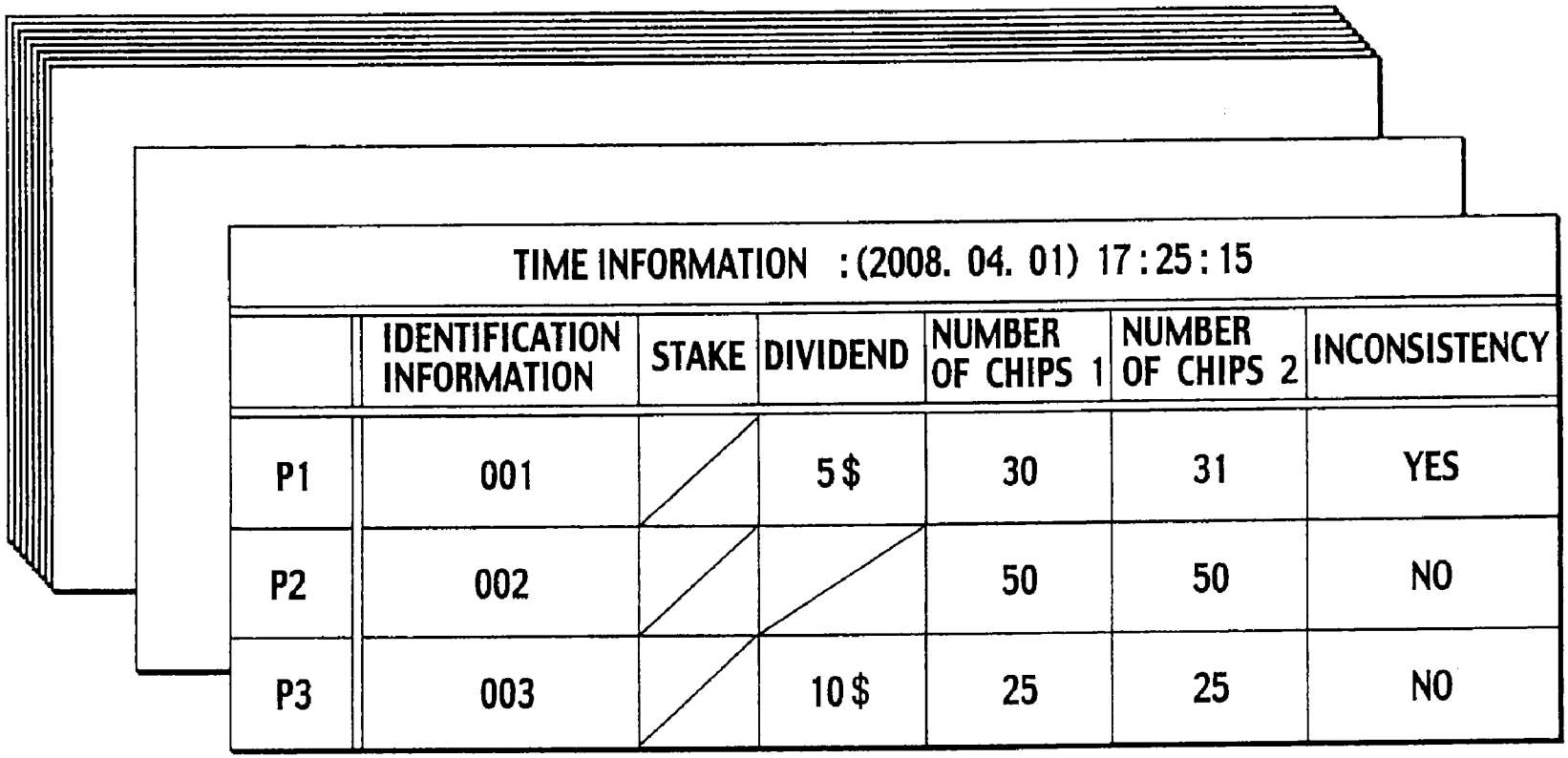
FIG. 10 is a diagram showing the concept of information stored during the chip reading processing according to the embodiment of the present invention.

FIG. 10 is a diagram showing the concept of the information on the value of the game chips 71 accumulated constantly during the processing of step S13 and the related information. In FIG. 10, 'P1', 'P2', and 'P3' indicate the seats of the players P1, P2, and P3. 'Identification information', 'Stake', and 'Dividend' are related each other and stored in this table wherein 'Identification information' identifies each player, 'Stake' indicates the value of the game chips 71 each player bet when the player bet game chips 71, and 'Dividend' indicates the value of the game chips 71 each player received as a return when the player received a return of game chips 71. In addition, 'Time information' that indicates the time is registered in the table in FIG. 10. Also registered in the table in FIG. 10 are 'Number of chips 1'that indicates the number of game chips 71 recognized by reading the wireless IC tags 72 and 'Number of chips 2' that indicates the number of game chips 71 recognized through image recognition based on an image from the camera 3. If there is an inconsistency between 'Number of chips 1' and 'Number of chips 2', 'Yes' is registered in the column 'Inconsistency'. If there is no inconsistency between 'Number of chips 1' and 'Number of chips 2', 'No' is registered in the column 'Inconsistency'. The time at which the data is acquired is registered in "Time information". Although the server device 6 judges the number of game chips 71 in step S7 through image recognition based on an image from the camera 3 in this embodiment, it is also possible to use a beam scan method to detect the height of the stacked game chips 71 for checking the number of game chips 71. It is also possible for the server device 6 to use a measuring apparatus, which weights the weight of the game chips 71 stacked in each area 34, to detect the weight of the stacked game chips 71 for checking the number of game chips 71.

Figure 11:
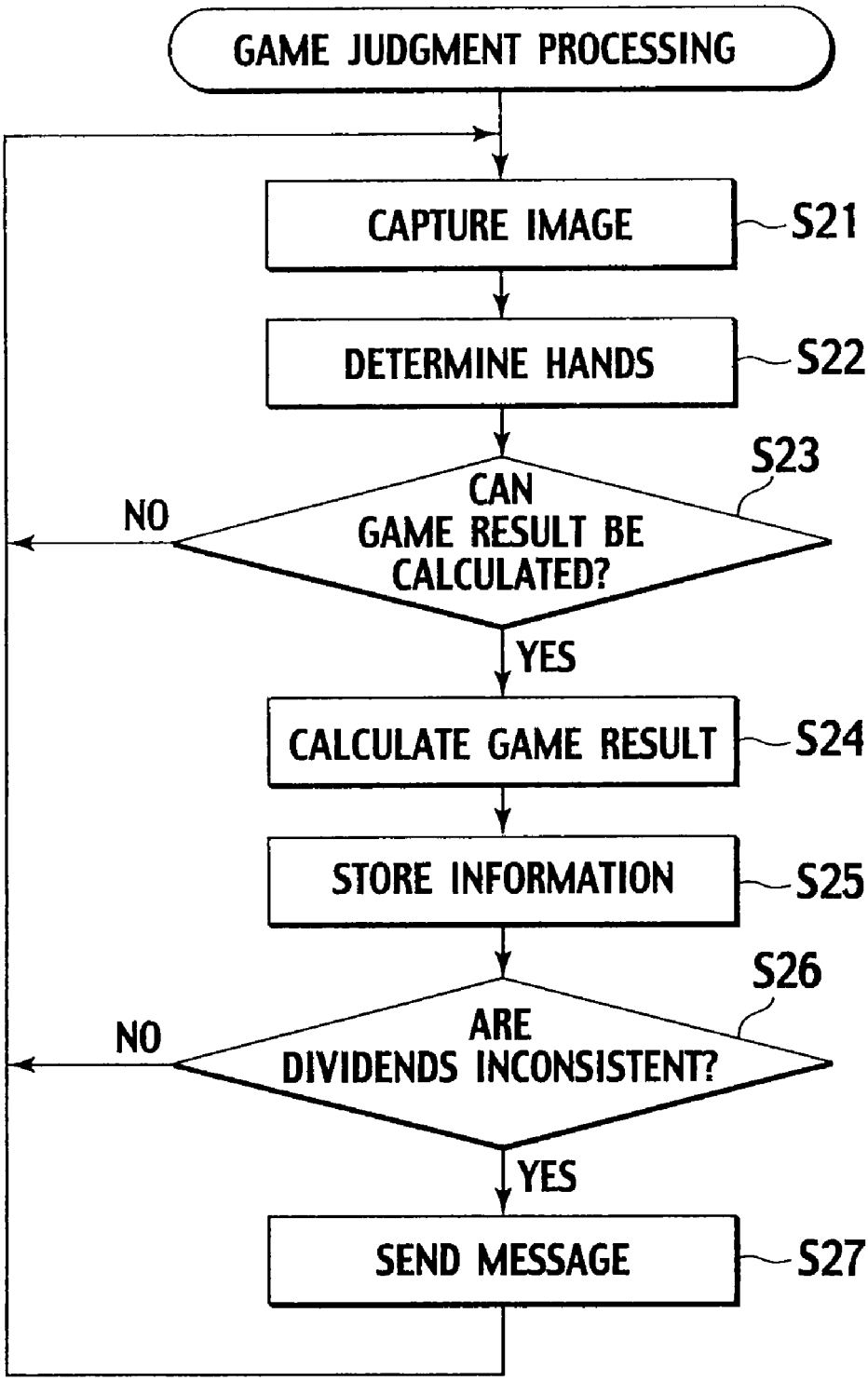
FIG. 11 is a flowchart showing game judgment processing according to the embodiment of the present invention.

FIG. 11 is a flowchart showing the game judgment processing performed by the server device 6 (more specifically, CPU 51). The blackjack is a game of cards. The dealer D deals cards to the players P1, P2, and P3 and to the dealer D. The cards dealt to each player are placed between the chip holding positions 32 of each player and the betting position 33 on the game betting board 31. The cards dealt to the dealer D are placed in front of the dealer D on the game betting board 31.

The camera 3 of each of the players P1, P2, and P3 and the dealer D takes a photo of the game betting board 31 in front of each of the players P1, P2, and P3 and the dealer D. In step S21, the server device 6 uses the camera 3 to capture the image of the cards dealt to each of the players P1, P2, and P3 and the dealer D. In step S22, the server device 6 recognizes the image of this image data and checks the hands of the players P1, P2, and P3 and the dealer D. Because the cards dealt to the players P1, P2, and P3 and the dealer D are placed on the game betting board 31 so that cards dealt to one person are apart from card dealt to other persons, each camera 3 can take a photo of the suit symbols and the numbers of the cards dealt to each player. So, the server device 6 can identify the card image data through image recognition and determine the suits and the numbers of the cards. More specifically, based on the suit symbol shape, color, and number of each card, the server device 6 determines if the card is a diamond, club, spade, or heart and finds its number. The server device 6, which can recognize the suit symbols and the numbers of the cards dealt to the players P1, P2, and P3 and the dealer D, references the internally-stored predetermined table to determine the hands of the players P1, P2, and P3 and the dealer D.

In step S23, the server device 6 judges if the game result can be calculated based on the suit symbols and the numbers of the cards that are dealt to the players P1, P2, and P3 and the dealer D and that change at every moment. If the game result can be calculated, control is passed to step S24. If the game result cannot be calculated, control is passed back to step S21.

In the blackjack, the dealer D first deals cards face-up, one to each of the players P1, P2, and P3, and one card face-down to himself or herself. After that, each player picks one or more cards. After all players P1, P2, and P3 pick cards, the dealer D picks one or more cards and turns over the face-down card. In this state, the server device 6 checks if the game result can be calculated. The server device 6 recognizes the hands of the players P1, P2, and P3 and the dealer D through image processing and compares the recognition results against a predetermined table in which the blackjack rule is described. If the hands of the players P1, P2, and P3 and the dealer D can be calculated, the server device 6 judges that the game result can be calculated.

In step S24, the server device 6 calculates the game result. More specifically, the server device 6 references the predetermined table in which the blackjack rule is described, determines the win/lose result of the players P1, P2, and P3 and the dealer D, and calculates the points and the dividends of the players P1, P2, and P3. The server device 6 references the stake amounts (value of the game chips 71 that are bet) of the players P1, P2, and P3, which are stored during the chip reading processing, and the predetermined table, in which the blackjack rule is described, for calculating the points and the dividends of the players P1, P2, and P3.

In step S25, the server device 6 stores the hands, win/lose results, stakes, points, and dividends of the players P1, P2, and P3 and the dealer D, as well as the information on the time at which the game result was calculated.

FIG. 12 shows the concept of the information stored in step S25. In FIG. 12, the seats of the players P1, P2, and P3 are indicated by 'P1', 'P2', and 'P3', and the seat of the dealer D is indicated by 'D'. In addition, the table in FIG. 12 stores 'Identification information' identifying each player (or dealer) , 'Hand' of each player (or dealer), 'Win/lose' indicating the win/lose result of each player (or dealer), and 'Stake', 'Odds', and 'Dividend' of each player, as well as "Time information".

In step S26, for a player who has won the game and received the dividend, the server device 6 compares the dividend calculated in step S24 with the dividend stored in the server device 6 during the chip reading processing to judge if the dividends are inconsistent. If the dividends are inconsistent, control is passed to step S27; if the dividends are consistent, control is passed back to step S21.

If the dividends are inconsistent, there is a possibility that the dealer D returned an incorrect dividend to the player mistakenly or returned an incorrect dividend to the player intentionally. So, in step S27, the server device 6 sends a message, which indicates that the payment of the dividend is incorrect, to the display device 4 and the terminal device 5 to notify the dealer D and the casino hotel manager of the fact. More specifically, to check if the dividends are inconsistent, the server device 6 compares the information on the dividend shown in FIG. 12 with the information on the dividend shown in FIG. 10 which was stored in conjunction with the time information immediately preceding the time related to the information on the dividend shown in FIG. 12.

Note that the server device 6 manages the games played on game betting devices (tables) other than the game betting device 2 in the same manner. That is, the server device 6 performs the balance calculation of stakes and dividends in real time for each player and for each table and sends the calculation results to the terminal device 5 to inform the casino hotel manager of the result.

In the game management system 1, the server device 6 compares, in step S26, the dividend calculated in step S24 with the dividend stored during the chip reading processing to check if the dividends are inconsistent and, if the dividends are inconsistent, informs the dealer D and the casino hotel manager of the fact. This means that the game management system 1 can check if the dealer D returns an incorrect dividend to the player mistakenly or returns an incorrect dividend to the player intentionally, thus preventing the gamechips 71 from being returned incorrectly.

Because the information shown in FIG. 10 is stored only when the information is different from the information that was read during the previous processing (steps S13 and S14) and because the information shown in FIG. 12 is stored only when the game result can be calculated (steps S24 and S25), the required storage capacity of the server device 6 can be reduced.

Although the information is read in this embodiment only from the wireless IC tags 72 of the game chips 71 placed in the areas 34 corresponding to the chip holding positions 32, the game chips 71 are actually read regularly from all areas 34 each time the read processing is performed. So, it is also possible to read and store the information from the wireless IC tags 72 of the game chips 71 placed in any of the areas 34. In this case, if there is a change in the value of the game chips 71 in any of the areas 34, the information that is read is stored; if there is no change in the value of the game chips 71 in any of the areas 34, the information that is read is discarded. This allows the system to keep track of the areas, where the game chips 71 are placed on the game betting board 31, that change at every moment.

In this embodiment, the hands of the players and the dealer are stored only if the game result can be calculated for the information shown in FIG. 12. Instead of this, it is also possible to check the hands of the players and the dealer regularly for comparing the hands of the players and the dealer between the current processing and the previous processing and, if there is a change in the hands of the players and/or the dealer, to store the hands. This allows the system to keep track of the hands of the players and the dealer that change at every moment.

Although the blackjack is used as an example in this embodiment, the processing in the game management system 1 described above is applicable also to a card game other than the blackjack and to roulette.

What is claimed is:

1. A game judgment system comprising:

a game betting board;

a reading unit that regularly reads chip information which is information on game chips placed in a predetermined range on the game betting board, wherein the information is recorded in wireless integrated circuit (IC) tags embedded in the game chips;

an obtainment unit that obtains information of an image, height or weight of the game chips placed in the predetermined range on the game betting board;

an information accumulation unit that associates with time information a first number of game chips identified based on chip information read by the reading unit and a second number of game chips identified based on information obtained by the obtainment unit, and accumulates the association;

a number-of-chips judgment unit that judges whether there is an inconsistency between the first number of game chips and the second number of game chips associated with a same time information, associates the judgment result with the first number of game chips, the second number of game chips and the time information, and sends, when there is an inconsistency, information indicative of the inconsistency;

a difference judgment unit that judges a difference between a value of game chips identified based on the first number of game chips accumulated by the information accumulation unit and a value of game chips identified based on another first number of game chips associated with another time information earlier than the time information with which the first number of game chips is associated;

a game result judgment unit that judges a result of a game on which the game chips are bet on the game betting board; and an inconsistency judgment unit that judges whether or not there is an inconsistency between the game result judged by the game result judgment unit and the difference judged by the difference judgment unit.

2. The game judgment system according to claim 1, further comprising a notifying unit that, if the inconsistency judgment unit judges that there is an inconsistency, sends information indicating there is an inconsistency.

3. The game judgment system according to claim 1, wherein the information accumulation unit compares chip information read by the reading unit with chip information accumulated previously and, if both differ, accumulates the chip information read by the reading unit and, if both are the same, discards the chip information read by the reading unit.

4. The game judgment system according to claim 1, wherein the chip information is information on the game chips which a player currently holds.

5. The game judgment system according to claim 1, further comprising a total value judgment unit that judges the total value of game chips based on the difference judged by the difference judgment unit.

6. The game judgment system according to claim 5, wherein when the game result judgment unit judges that a player wins, the total value judgment unit calculates a dividend for the player based on the total value of the game chips.

7. The game judgment system according to claim 6, wherein the inconsistency judgment unit judges whether there is an inconsistency between the dividend calculated by the total value judgment unit and the difference judged by the difference judgment unit.

8. The game judgment system according to claim 1, further comprising a chip record unit that records identification information of a player in a game chip given to the player before the game starts, and records identification information of a player read by the reading unit from the game chips placed in the predetermined range on the game betting board, in a game chip paid out by a dealer based on the game result.

9. The game judgment system according to claim 1, wherein the obtainment unit obtains information on a height of the game chips in a beam scan manner.

10. The game judgment system according to claim 1, wherein the obtainment unit obtains information on a weight of the game chips using a measuring apparatus.

11. A game judgment method comprising:

reading chip information, which is information on game chips placed in a predetermined range on a game betting board, from wireless integrated circuit (IC) tags embedded in the game chips;

obtaining information of an image, height or weight of the game chips placed in the predetermined range on the game betting board;

associating with time information a first number of game chips identified based on the read chip information and a second number of game chips identified based on the obtained information, and accumulating the association;

judging whether there is an inconsistency between the first number of game chips and the second number of game chips associated with a same time information, associating the judgment result with the first number of game chips, the second number of game chips and the time information, and sending, when there is an inconsistency, information indicative of the inconsistency;

judging, by a difference judging unit, a difference between a value of game chips identified based on the first number of game chips accumulated in the accumulating and a value of game chips identified based on another first number of game chips associated with another time information earlier than the time information with which the first number of game chips is associated;

determining a result of a game on which the game chips are bet on the game betting board; and determining whether there is an inconsistency between the determined result of the game and the difference judged by the difference judgment unit.

* * * * *